US006192547B1

(12) United States Patent
Song

(10) Patent No.: US 6,192,547 B1
(45) Date of Patent: Feb. 27, 2001

(54) AIR CURTAIN SYSTEM USED IN MANUFACTURING THIN FILM TRANSISTOR LIQUID CRYSTAL DISPLAY

(75) Inventor: Young-Ho Song, Seoul (KR)

(73) Assignee: LG. Philips LCD Co. Ltd., Seoul (KR)

( * ) Notice: Subject to any disclaimer, the term of this patent is extended or adjusted under 35 U.S.C. 154(b) by 0 days.

(21) Appl. No.: 09/282,978

(22) Filed: Mar. 31, 1999

(30) Foreign Application Priority Data

Aug. 14, 1998 (KR) ..... 98-32967

(51) Int. Cl.[7] ..... B08B 5/02; B08B 1/00
(52) U.S. Cl. ..... 15/308; 15/309.2; 15/316.1
(58) Field of Search ..... 15/309.1, 309.2, 15/316.1, 308

(56) References Cited

U.S. PATENT DOCUMENTS 2,766,720 * 10/1956 Muller et al. ..... 15/309.1 X
3,849,831 * 11/1974 DeVerter et al. ..... 15/316.1 X
3,917,888 * 11/1975 Beam et al. ..... 15/309.1 X
4,120,070 * 10/1978 Severin ..... 15/316.1 X
4,281,431 * 8/1981 Nierlich et al. ..... 15/309.1 X

* cited by examiner

*Primary Examiner*—Chris K. Moore

(57) ABSTRACT

An air curtain system for forming an air curtain dividing two processing spaces and for spraying air on to a substrate to remove any impurities remaining on the substrate includes an air supplier, a main body having an air inlet passage for receiving air from the air supplier, an air flow space defined within the main body and communicating with the inlet passage, and a slit extending from the air flow space to spray the air on the substrate, and a substantially strip-shaped rectifying lattice provided with a plurality of openings located at an equal distance from each other. The lattice is positioned within the air flow space.

22 Claims, 4 Drawing Sheets

AIR CURTAIN SYSTEM USED IN MANUFACTURING THIN FILM TRANSISTOR LIQUID CRYSTAL DISPLAY

CROSS REFERENCE TO RELATED ART

This application claims priority of Korean Patent Application No. 98-32967 filed on Oct. 14, 1998, the entire disclosure of which is hereby incorporated herein by reference.

BACKGROUND OF THE INVENTION

1. Field of the Invention

The present invention relates to an air curtain system used in manufacturing a thin film transistor-liquid crystal display ("TFT-LCD"), and more particularly, to an air curtain system for constantly spraying air or $N_2$ gas on an LCD substrate to remove a solution remaining after such solution is used for removing a photoresist, the photoresist being used for patterning an electrode of the LCD.

2. Description of the Related Art

FIG. 1 illustrates, in cross-section view, a portion of a glass substrate as it undergoes sequential processing steps for forming an electrode such as an indium tin oxide (ITO) electrode thereon.

An electrode-forming layer 102 is first deposited on a glass substrate 101, after which the glass substrate 101 is cleaned using a cleaning solution. Next, a photoresist 103 is deposited on the electrode-forming layer 102, and exposed to a light using a photo mask 104 to obtain a desirably patterned photoresist 103*a* through a developing process.

Following the above steps, the electrode forming layer 102 is etched using the patterned photoresist 103*a* as a mask, then the patterned photoresist 103*a* is removed through a stripping process, thereby obtaining a desirably patterned electrode 112.

In the stripping process, a photoresist may remain on the glass substrate 101 and the patterned electrode 112, and is removed using a stripping solution which is sprayed at a high pressure on the glass substrate 101.

After this step, to clean away the stripping solution, the substrate 101 is conveyed to an air curtain system.

FIGS. 2 and 3 show a conventional air curtain system.

An air curtain system 105 includes a front plate 105*a* and a rear plate 105*b*, between which a space 109 is defined. A slit 108 having a clearance of 0.1 mm extends downward from the space 109. Two air suppliers 110 for supplying air to the space 109 are symetrically mounted on the front plate 105*a*. An air tube 107 is connected to the air supplier 110. The air or $N_2$ gas is supplied from the air tube 107 to the space 109 through a passage 106 formed in the air supplier 110. The air supplied to the space 109 is sprayed on the substrate 101 through the slit 108 in order to remove the remaining stripping solution.

At this point, the air sprayed through the slit 108 further functions as a curtain for blocking fumes which are generated during processing of a downstream substrate.

However, as shown in FIG. 3, since the air on $N_2$ gas supplied from the two air suppliers 108 is sprayed directly toward the substrate through the slit 108 without any obstruction, the air pressure difference may occur between three portions of the slit 108 corresponding to regions R1, R2 and R3, respectively. Therefore, the air curtain system having the structure described above has a drawback in that, since the air pressure is not uniform throughout the slit 108, the stripping solution remaining may not be completely removed. In addition, if the air pressure is increased to completely remove the remaining stripping solution, the substrate and the electrode may be damaged.

SUMMARY OF THE INVENTION

In order to overcome the problems described above, preferred embodiments of the present invention provide an air curtain system which effectively removes a stripping solution which is used to remove a remaining photoresist material used in patterning an electrode of an LCD, while effectively blocking fumes generated during processing of a substrate in a downstream process.

According to one preferred embodiment of the present invention, an air curtain system is constructed to form an air curtain which divides two processing spaces and sprays air onto a substrate to remove any impurities remaining on the substrate. The air curtain system preferably includes an air supplier, a main body having an air inlet passage for receiving air from the air supplier, an air flow space defined within the main body and communicating with the inlet passage, and a slit extending from the air flow space to spray the air on the substrate, an air distributing means supported within and across the gas flow space downstream from the gas inlet passage, the air distributing means distributing the gas to be sprayed uniformly toward the substrate through the slit; and an impurity removing means for primarily removing impurities from the substrate, the impurity removing means mounted on the main body and arranged before the slit, whereby the impurities on the substrate are sequentially removed by the impurity removing means and the gas sprayed from the slit of the main body.

The main body preferably includes a front plate and a rear plate which is coupled on a rear side of the front plate, the air inlet passage extending through the front plate, the air flow space and the slit being defined between the front and rear plates.

Preferably, the main body may include a clearance adjusting bolt for coupling the front and rear plates and adjusting the clearance of the slit.

According to a preferred embodiment of the present invention, the air regulator may include a substantially strip-shaped rectifying lattice fixed on the front and rear plates within the air flow space, the rectifying lattice being provided with a plurality of openings, each opening equidistantly spaced from the two adjacent opening.

Preferably, the air curtain system further includes a balance adjusting unit which is arranged to adjust a balance of the system. The balance adjusting unit preferably includes a pair of brackets mounted substantially symmetrically on a top of the main body and a pair of screws positioned on the brackets.

Preferably, the air curtain system further includes an impurity removing unit which is constructed and arranged to remove impurities from the substrate before the impurities on the substrate are removed by the air sprayed from the main body. The impurity removing unit is preferably mounted on the front plate.

The impurity removing unit preferably includes a supporting bar mounted on the front side of the air supplier and extending downward, a plate mounted on a lower end of the supporting bar, and a knife member integrally connected in a substantially perpendicular manner relative to a lower side of the plate and substantially parallel to the substrate to be treated.

Preferably, the supporting bar has a longitudinal hole to adjust a height of the knife member, the longitudinal hole being slidably coupled to a guide bolt which is integrally formed on a front surface of the air supplier.

Preferably, the knife member is provided at its extreme end with a solution-removing blade for effectively removing excessive solution which is remaining on the substrate.

Other elements, features, advantages and components of preferred embodiments of the present invention will be described in further detail with reference to the drawings attached hereto.

BRIEF DESCRIPTION OF THE DRAWINGS

The accompanying drawings, which are incorporated in and constitute a part of the specification, illustrate preferred embodiments of the present invention, and, together with the description, serve to explain the principles of the present invention.

DETAILED DESCRIPTION OF PREFERRED EMBODIMENTS

Figure 1:
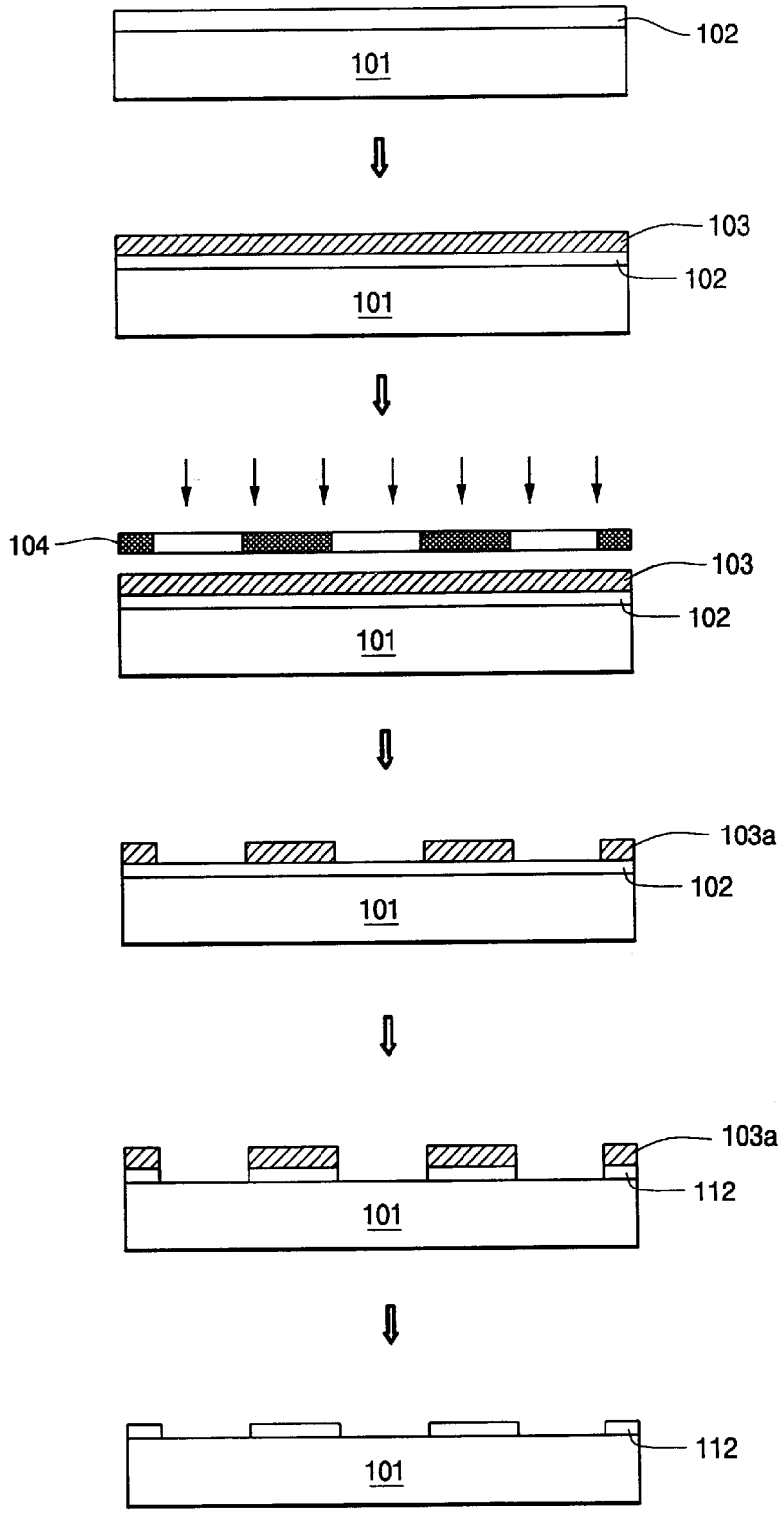
(PRIOR ART) FIG. 1
FIG. 1 illustrates, in cross-section, a portion of an LCD substrate as it undergoes sequential processing steps for being patterned.
Figure 2:
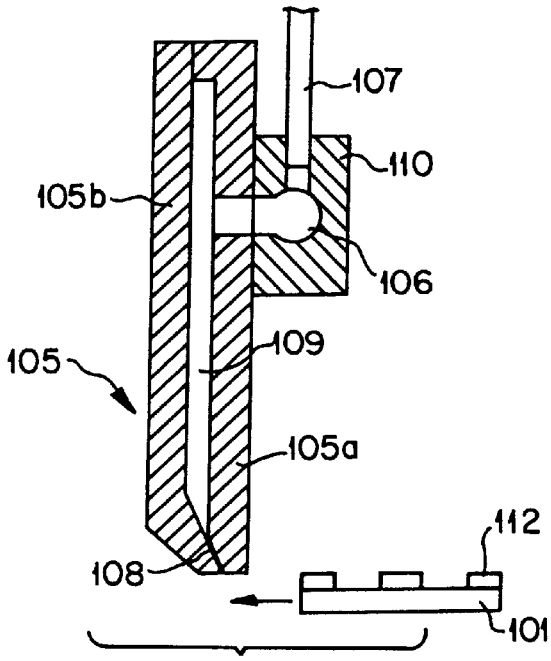
FIG. 2 (PRIOR ART)
FIG. 2 is a schematic sectional view illustrating a conventional air curtain system.
Figure 3:
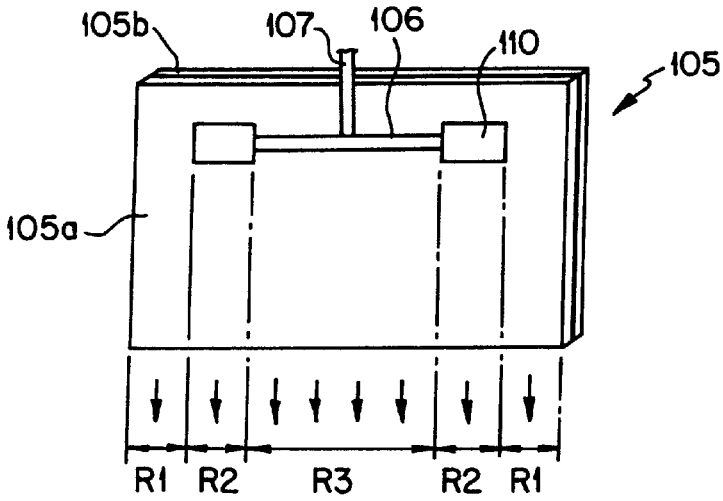
FIG. 3 (PRIOR ART)
FIG. 3 is a front view of the conventional air curtain system of FIG. 2.

Preferred embodiments of the present invention will now be described in detail with reference to the accompanying drawings.

Certain terminology will be used in the following description for convenience and reference only, and will not be limiting. The words "front", "rear", "upper" and "lower" will designate directions in the drawings to which reference is made.

Figure 4:
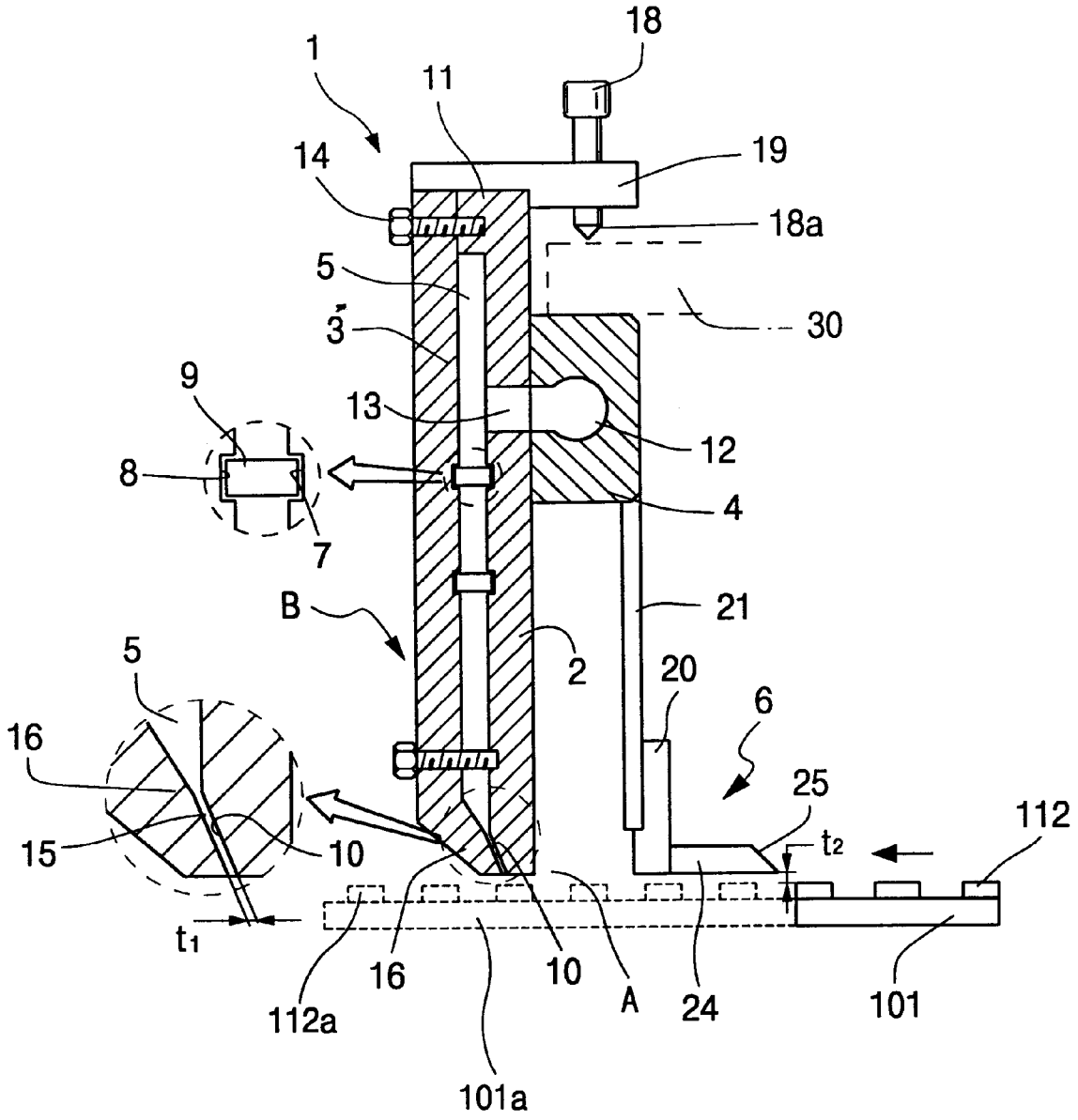
FIG. 4 is a sectional view of an air curtain system according to a preferred embodiment of the present invention.

Referring first to FIG. 4, an air curtain system according to a preferred embodiment of the present invention includes a main body B having a front plate 2 and a rear plate 3 coupled to a rear side of the front plate 2. Symmetrically mounted on a front side of the front plate 2 are two air suppliers 4. The front plate 2 has located at its rear surface at least two front horizontal grooves 7, and 8 and has located at its rear lower surface, a slanted portion 10. The front plate 2 further includes at its rear upper side, a projection 11 extending in a rearward direction. The projection 11 defines a space 5 between the front plate 2 and the rear plate 3. In one example of a preferred embodiment of the present invention, the space 5 is generally defined and constructed so as to have a volume of about 24.8 $cm^3$, for example.

The front plate 2 is further provided with a passage 13 which is located upstream from the front horizontal grooves 7. The passage 13 is arranged to communicate with a connecting passage 12 of the air supplier 4.

A plurality of gap adjusting bolts 14 are provided on the rear plate 3 to adjust a dimension or volume of the space 5. The rear plate 3 has at its front surface rear horizontal grooves 8 corresponding to the front horizontal grooves 7. Rectifying lattices 9 are fixed in the front and rear horizontal grooves 7 and 8.

Figure 6:
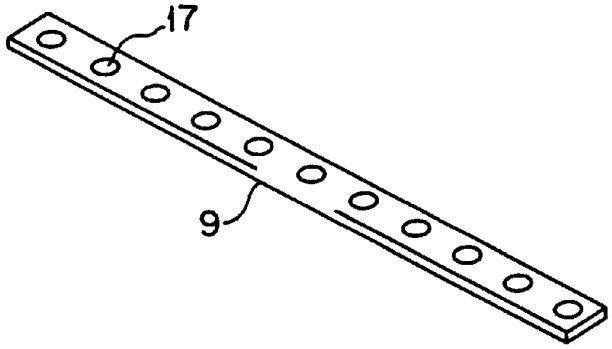
FIG. 6 is an enlarged perspective view illustrating a rectifying lattice depicted in FIG. 4.

Each of the rectifying lattices 9, as shown in FIG. 6, preferably includes a substantially strip-shaped member which has a thickness of about 1 mm and a width of about 6.5 mm, for example. A plurality of openings 17 are formed in each of the rectifying lattices 9. Preferably, the openings 17 are equidistantly spaced away from one another. for example, about 9 mm. Each of the openings 17 has a diameter of, for example, about 3.5 mm.

Therefore, as the horizontal grooves 7 and 8 are arranged downstream from the passage 13 communicating with the connecting passage 12 of the air supplier 4, the air fed through the passages 12 and 13 passes through the openings 17 formed in the rectifying lattices 9. In addition, since the openings 17 are spaced equidistantly from one another the flow rate of the air passing the air curtain system 1 becomes constant. In other words, the air on $N_2$ gas from air sources (not shown) is supplied to the two air supplies 4 symmetrically arranged and spaced apart from each other, and then air or $N_2$ gas from the two air suppliers 4 in supplied to the space 5 through the two passages 13. At this point, the air pressure in the space 5 at the two air suppliers 4 is relatively high, while the air pressure in the space 5 between the two air suppliers 4 is relatively low. However, the air $N_2$ gas from the two passages 13 is passed through the space 5 by two rectifying lattices 9 having a plurality of the openings 17 such that the air $N_2$ gas passing through the two rectifying lattices 9 is distributed uniformly regardless of the position of the air supplier and sprayed toward the substrate through the slit 15.

The air or $N_2$ gas passing through the rectifying lattices 9 is sprayed toward the substrate 101, on which the electrode 112 is formed, via a slit 15 defined between the front slanted portion 10 disposed on the rear lower surface of the front plate 2 and a rear slant 16 disposed on the front lower surface of the rear plate 3. The slit 15 has a clearance t1 of, for example, about 0.1 mm such that an air curtain is formed while the air passes through the slit 15.

In the above described preferred embodiment, although the rectifying lattices 9 are preferably substantially strip-shaped, this is not limiting of the present invention. That is, the rectifying lattice 9 can be substantially rectangular or substantially rod-shaped. In addition, more than three rectifying lattices can be provided.

In addition, the clearance of the slit 15 can be adjusted according to the level of air pressure to be supplied. This is achieved by the gap adjusting bolt 14. That is, by adjusting the gap adjusting bolt 14 in a state where a limit gauge (not shown) is inserted into the slit 15, the clearance of the slit 15 can be adjusted easily and accurately.

In addition, the width of the space 5 between the front and rear plates 2 and 3 is preferably less than about 6.5 mm as the width of the rectifying lattice 9 is preferably about 6.5 mm.

Preferably, two screws 18 (shown in FIGS. 4 and 5) are further provided to balance the air curtain system 1 mounted on a supporter 30. As shown in FIG. 4, the screws, being spaced apart from one another, are mounted on a pair of brackets 19 which are. symmetrically mounted on the main body B defined by the front and rear plates 2 and 3. Each of the screws 18 includes a measuring rod 18*a,* a lower end of which contacts the supporter 30 to be fixed. Each screw 18 is adjustable in an up-and-down direction separately and, therefore the balance of the air curtain system 1 is controlled precisely and a distance between the slit 15 and the substrate 101 can also be controlled.

Therefore, the air curtain system 1 is precisely balanced within about 0.01 mm or less by the screws 18 and can be fixed by a connector such as bolts (not shown).

The air curtain system 1 further includes a pre-treatment member 6 for primarily removing the remaining solution before it is removed by the air sprayed from the main body B, the pre-treatment member 6 being mounted on the front side of the air supplier 4 and adjustable in an up-and-down direction.

Figure 5:
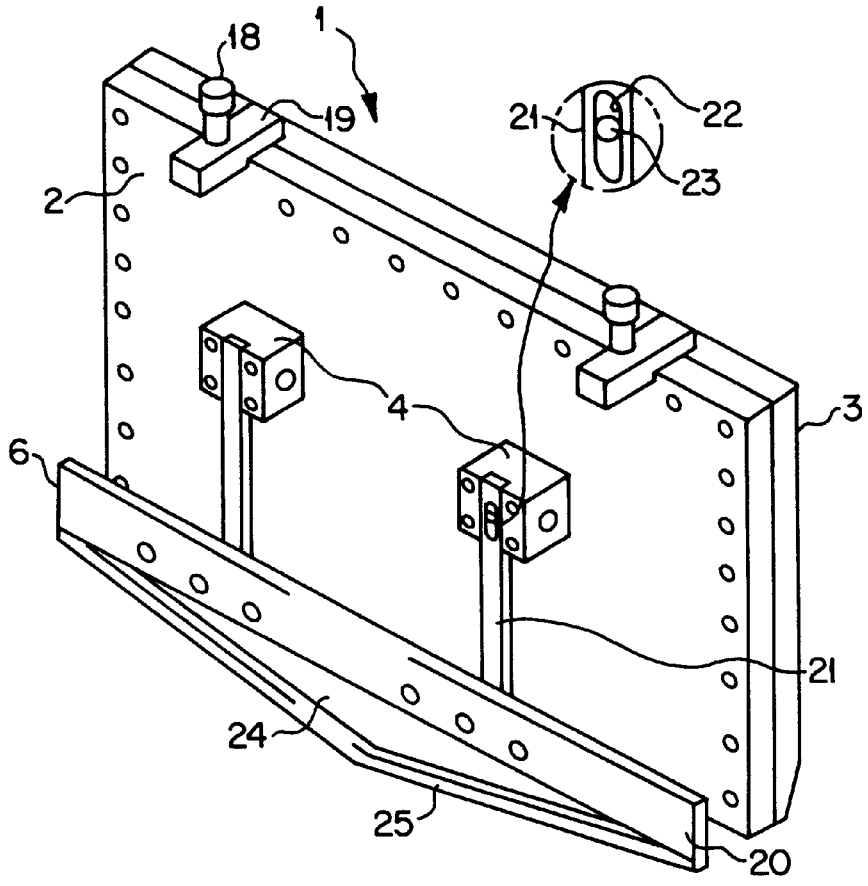
FIG. 5 is a front view of the air curtain system shown in FIG. 4.

As shown in FIG. 5, the pre-treatment member 6 preferably includes a pair of supporting bars 21 mounted on the front side of the air supplier 4 and extending downward, a plate 20 mounted on a lower end of the supporting bars 21, and a knife member 24 integrally formed substantially perpendicular to a lower side of the plate 20 and substantially parallel to the substrate to be treated. Each of the supporting bars 21 has longitudinal holes 22 to adjust a height of the knife member 24. The knife member 24 is provided at its extreme end with a solution-removing blade 25 for removing excessive remaining solution on the electrode 112.

Therefore, the remaining solution is first removed as the substrate 101 is conveyed to the air curtain system 1 in a direction indicated by an arrow in FIG. 4. That is, the remaining solution existing above a clearance t2 (see FIG. 4) is first removed by the blade 25 of the knife member 24, then the rest of the remaining solution is removed by the air sprayed through the main body B.

The knife member 24 is preferably triangle-shaped to effectively remove the remaining solution.

In addition, because of the presence of the knife member 24, the amount of solution that should be removed by the main body B can be small, thus, the possibility of contaminating other portions such as the treated part of the substrate is greatly reduced. If the amount of the solution that the main body should dry is relatively large, the solution blown by the main body B can be splashed about and can contaminate the treated substrate 101*a* or the treated electrode 109*a*.

Referring to FIGS. 4 and 5, to fix the pre-treatment member 6 on the air supplier 4, a limit gauge (not shown) is positioned in the clearance t2 between the knife member 24 and the substrate 101 in a state where guide bolts 23, integrally formed on the air supplier 4 and slidably positioned in the longitudinal holes 22 formed in the supporting bars 21, are released.

Accordingly, the clearance t2 between the knife member 24 and the substrate 101 is adjusted in a state where the knife member 24 is supported by the substrate 112 through the limit gauge.

Next, by bolting the bolts 23 tightly, thereby fixing the position of the longitudinal holes 22 formed on the air supplier 4 using nuts (not shown), a height of the pretreatment member 6 with respect to the substrate 101 can be precisely adjusted.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. An air curtain system for forming an air curtain dividing two processing spaces and for spraying gas on a substrate to remove any impurities remaining on the substrate, the air curtain system, comprising a gas supplier for supplying gas;

a main body having a gas inlet passage for receiving gas from the gas supplier, a gas flow space defined within the main body and communicating with the inlet passage, and a slit extending from the gas flow space;

an air distributor supported within and across the gas flow space downstream from the gas inlet passage, the air distributor distributing the gas to be sprayed uniformly toward the entire substrate through the slit; and an inpurity remover to primarily remove impurities form the substrate, the impurity remover being mounted on the main body and arranged adjacent to the slit, whereby the impurities on the substrate are sequentially removed by the impurity remover and then by the gas sprayed from the slit of the main body.

2. The air curtain system of claim 1, wherein the main body comprises a front plate and a rear plate coupled on a rear side of the front plate, the gas inlet passage extending through the front plate, the gas flow space and the slit being defined between the front and rear plates.

3. The air curtain system of claim 2, wherein the main body further comprises a clearance adjusting bolt for coupling the front and rear plates and adjusting a clearance of the slit.

4. The air curtain system of claim 2, wherein the air distributor comprises a substantially strip-shaped rectifying lattice fixed on the from and rear plates within the gas flow space, the rectifying lattice being provided with a plurality of openings, each opening equidistantly spaced form one another.

5. The air curtain system of claim 2, wherein the impurity remover means comprises a supporting bar mounted on the front side of the gas supplier and extending downward, a plate mounted on an lower end of the supporting bar, and a knife member integrally formed substantially perpendicular to a lower side of the plate and substantially parallel to the substrate to be treated.

6. The air curtain system of claim 5, wherein the supporting bar has a longitudinal hole arranged to adjust a height of the knife member, the longitudinal hole being slidably coupled to a guide bolt integrally formed on a front surface of the gas supplier.

7. The air curtain system of claim 6, wherein the knife member is provided at its extreme end with a solution removing blade for effectively removing excessive openings arranged at a substantially equal distance from each other.

8. The air curtain system of claim 1, comprising a balance adjuster to adjust a balance of the system.

9. The air curtain system of claim 8, wherein the balance adjuster comprises a pair of brackets mounted symmetrically on a top of the main body and a pair of screws positioned on the brackets.

10. An air curtain system for forming an air curtain dividing two processing spaces and for spraying gas on a substrate to remove any impurities remaining on a substrate, the air curtain system, comprising:

a gas supplier;

a gas receiver including an inlet passage for receiving gas from the gas supplier, a gas flow defined within the gas receiver and communicating with the inlet passage, and a slit extending from the gas flow space to spray the gas on the substrate;

an air distributor, supported within and across the gas flow space downstream from the inlet passage, the air distributor distributing the gas to be sprayed uniformly toward the substrate through the slit; and a remover to remove impurities from the substrate, the remover being mounted on the gas receiver and arranged adjacent to the slit, whereby the impurities on the substrate are sequentially removed by the remover and then by the gas sprayed from the slit.

11. The air curtain system of claim 10, wherein the receiver comprises a front plate and a rear plate coupled on a rear side of the front plate, the inlet passage extending through the front plate, the gas flow space and the slit being defined between the front and rear plates.

12. The air curtain system of claim 11, wherein the gas receiver comprises a clearance adjusting bolt for coupling the front and rear plates and adjusting a clearance of the slit.

13. The air curtain system of claim 11, wherein the air distributor comprises a substantially strip-shaped rectifying lattice fixed on the front and rear plates within the gas flow space, the rectifying lattice being provided with a plurality of openings, each opening equidistantly spaced from one another.

14. The air curtain system of claim 11, wherein the remover comprises a supporting bar mounted on the front side of the gas supplier and extending downward, a plate mounted on a lower end of the supporting bar, and a knife member integrally formed substantialy perpendicular to a lower side of the plate and substantially parallel to the substrate to be treated.

15. The air curtain system of claim 14, wherein the supporting bar has a longitudinal hole arranged to adjust a height of the knife member, the longitudinal hole being slidably coupled to a guide bolt integrally formed on a front surface of the gas supplier.

16. The air curtain system of claim 15, wherein the knife member is provided at its extreme end with a solution removing blade for effectively removing excessive solution remaining on the substrate.

17. The air curtain system of claim 10, further comprising, a balance adjuster to adjust a balance of the system.

18. The air curtain system of claim 17, wherein the balancer adjuster comprising a pair of brackets mounted symmetrically on a top of the main body and a pair of screws positioned on the brackets.

19. An air flow generating apparatus, comprising:

a body comprising a first plate and a second plate, the first and second plates defining a passage therebetween;

a nozzle formed at an end of the passage by tapered portions of the first and second plates;

a gas supplier operatively connected with the first plate to supply gas through the passage and out the nozzle; and a substance remover operatively connected to the body and positioned adjacent to the nozzle so that substances coming into contact with the substance remover are physically removed before gas from the nozzle acts to further remove and remaining substances.

20. The apparatus of claim 19, further comprising a plurality of connectors to adjustably connected the first and second plates to thereby adjust a width of the passage and a width of the nozzle.

21. The apparatus of claim 20, further comprising a plurality of baffles in operative connection between the first and second plates, and positioned within the passage at a downstream portion between the gas supplier and the nozzle.

22. The apparatus of claim 21, wherein each baffle comprises an elongated body having a plurality of openings therein, the openings allowing a uniform gas flow to exit the nozzle.

* * * * *